US012297574B2

(12) United States Patent
Ueda et al.

(10) Patent No.: US 12,297,574 B2
(45) Date of Patent: May 13, 2025

(54) EMBROIDERY SEWING MACHINE INCLUDING CARRIAGE FOR MOVING EMBROIDERY FRAME ATTACHED THERETO

(71) Applicant: BROTHER KOGYO KABUSHIKI KAISHA, Nagoya (JP)

(72) Inventors: Daisuke Ueda, Seto (JP); Katsuhisa Hasegawa, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 8 days.

(21) Appl. No.: 18/338,629

(22) Filed: Jun. 21, 2023

(65) Prior Publication Data

US 2024/0003068 A1 Jan. 4, 2024

(30) Foreign Application Priority Data

Jun. 30, 2022 (JP) ..... 2022-106265

(51) Int. Cl.
*D05C 9/06* (2006.01)
*D05C 3/00* (2006.01)

(52) U.S. Cl.
CPC ..... *D05C 9/06* (2013.01); *D05C 3/00* (2013.01)

(58) Field of Classification Search
CPC ..... D05C 9/00–10; D05C 3/00–04
See application file for complete search history.

(56) References Cited

U.S. PATENT DOCUMENTS 652,326 A * 6/1900 Parkes ..... D05B 3/02 112/98
2,866,423 A * 12/1958 Passons ..... D04G 3/02 33/27.01
3,741,140 A * 6/1973 Mercaldi ..... D05B 21/00 112/102
5,906,168 A * 5/1999 Ito ..... D05B 77/00 D15/75

FOREIGN PATENT DOCUMENTS

JP 2003144782 A * 5/2003
JP 5692973 B2 * 4/2015
JP 3210727 U 6/2017

* cited by examiner

*Primary Examiner* — Ismael Izaguirre
(74) *Attorney, Agent, or Firm* — Oliff PLC

(57) ABSTRACT

An embroidery sewing machine includes a bed portion, a column portion, an arm portion, and a carriage. The bed portion extends in a first direction. The column portion extends upward from an end portion of the bed portion. The arm portion extends in the first direction from an upper end portion of the column portion. The arm portion includes a support portion provided at one side portion of the arm portion in a second direction crossing the first direction. The carriage includes a frame moving portion and a carriage moving portion. The frame moving portion is configured to move an embroidery frame attached to the carriage. The carriage moving portion is configured to move the frame moving portion in the first direction. The carriage moving portion is supported by the support portion. The carriage moving portion extends downward and has a lower end portion connected to the frame moving portion.

11 Claims, 8 Drawing Sheets

EMBROIDERY SEWING MACHINE INCLUDING CARRIAGE FOR MOVING EMBROIDERY FRAME ATTACHED THERETO

REFERENCE TO RELATED APPLICATIONS

This application claims priority from Japanese Patent Application No. 2022-106265 filed on Jun. 30, 2022. The entire content of the priority application is incorporated herein by reference.

BACKGROUND ART

Some conventional sewing machines utilize a free-arm type bed portion. When sewing tube-like or bag-like workpieces in the conventional sewing machines, the workpiece can be placed around the bed portion while sewing. Conventional embroidery machines that function to embroider workpieces have a carriage arranged on the top surface of the bed portion for moving an embroidery frame. Consequently, a tube-like or bag-like workpiece placed around the bed portion would interfere with the carriage operations.

For example, one conventional sewing machine has drive mechanisms on both sides of the arm portion for moving the carriage in a Y-direction, which is the front-rear direction when viewed from the front of the sewing head. The carriage in this sewing machine moves an embroidery frame in an X-direction, which is the left-right direction when viewed from the front of the sewing head. Thus, the sewing machine can move the embroidery frame in both the X- and Y-directions. In this sewing machine, the carriage is suspended from the arm portion, allowing the use of a free-arm type bed portion for embroidering tube-like or bag-like workpieces.

DESCRIPTION

The carriage in the conventional sewing machine is configured to be suspended from both sides of the arm portion. As a result, the casing of the sewing machine is larger and heavier, requiring more effort for the user to carry the sewing machine for in-home use. Further, the drive mechanisms are provided on both sides of the arm portion, increasing the number of parts and the overall cost.

In view of the foregoing, it is an object of the present disclosure to provide an embroidery sewing machine that is compact and lightweight and can reduce production costs.

In order to attain the above and other object, according to one aspect, the present disclosure provides an embroidery sewing machine including a bed portion, a column portion, an arm portion, and a carriage. The bed portion extends in a first direction. The column portion extends upward from an end portion of the bed portion. The arm portion extends in the first direction from an upper end portion of the column portion. The arm portion has one side portion and the other side portion in a second direction crossing the first direction. The arm portion includes a support portion provided at the one side portion of the arm portion. An embroidery frame for holding a workpiece is attachable to the carriage. The carriage includes a frame moving portion and a carriage moving portion. The frame moving portion is configured to move the embroidery frame in the second direction in a state where the embroidery frame is attached to the carriage. The carriage moving portion is configured to move the frame moving portion in the first direction. The carriage moving portion is supported by the support portion. The carriage moving portion extends downward and having a lower end portion connected to the frame moving portion.

Figure 1:
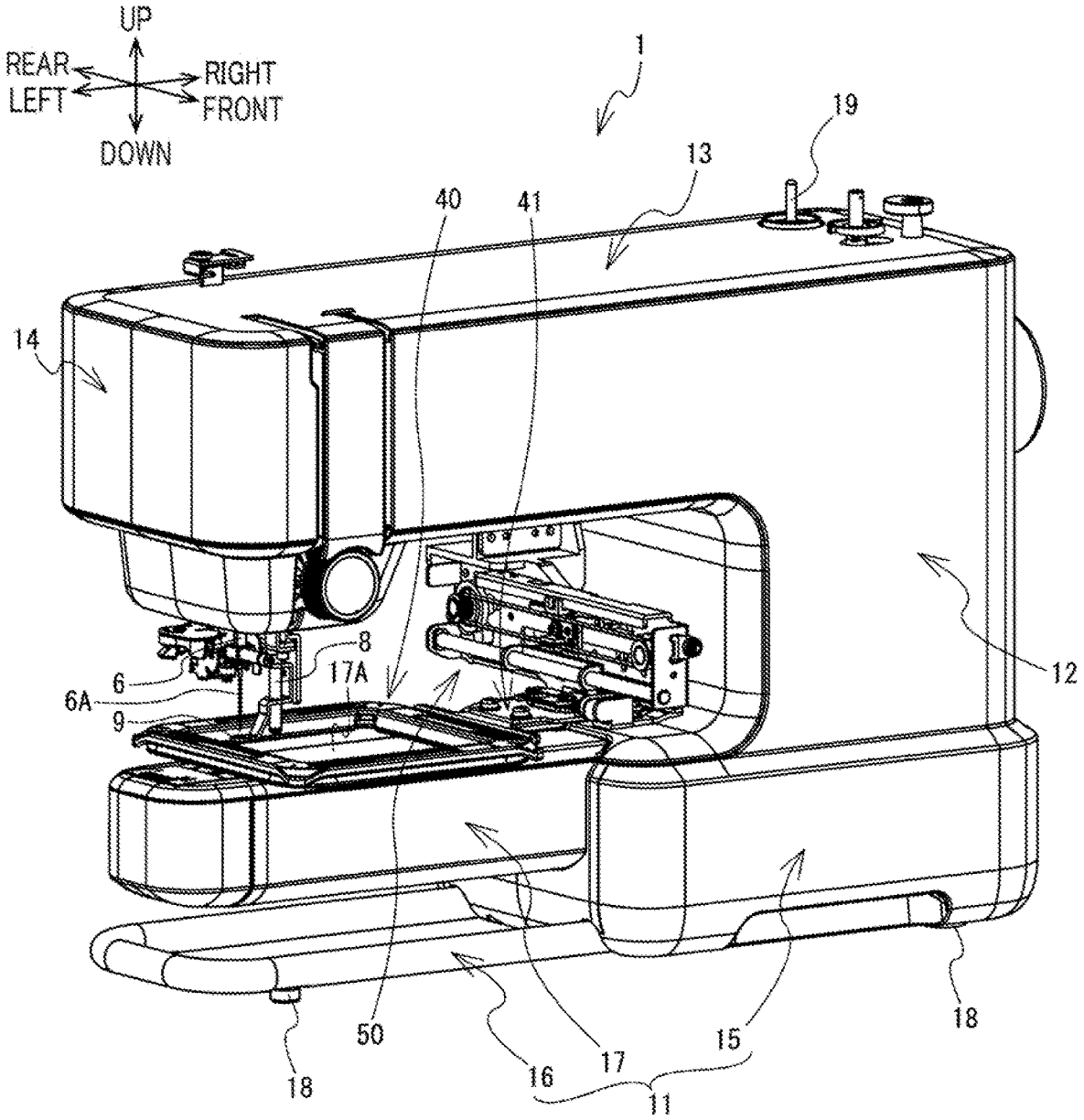
FIG. 1 is a perspective view of an embroidery sewing machine 1 from the front-upper-left side thereof.

Next, an embodiment of the present disclosure will be described while referring to the accompanying drawings. Here, the configuration of an embroidery sewing machine 1 having a carriage 50 that can move an embroidery frame 40 will be described with reference to FIG. 1. The top, bottom, lower-right, upper-left, lower-left, and upper-right of the embroidery sewing machine 1 in FIG. 1 will respectively denote the top, bottom, front, rear, left, and right sides of the embroidery sewing machine 1. The longitudinal direction of a bed portion 11 and an arm portion 13 of the embroidery sewing machine 1 will be the left-right direction of the embroidery sewing machine 1. The side of the embroidery sewing machine 1 on which a column portion 12 is provided will be the right side. The extended direction of the column portion 12 will be the vertical direction (the up-down direction) of the embroidery sewing machine 1.

As shown in FIG. 1, the embroidery sewing machine 1 includes a sewing machine frame 2 (see FIG. 2), the bed portion 11, the column portion 12, the arm portion 13, a head portion 14, and the carriage 50. As shown in FIG. 1, a cover covers the sewing machine frame 2, bed portion 11, column portion 12, arm portion 13, and head portion 14. The sewing machine frame 2 is a single metal frame that internally supports the bed portion 11, column portion 12, arm portion 13, and head portion 14. In a rear view, the sewing machine frame 2 has a general C-shape.

The bed portion 11 is the base portion of the embroidery sewing machine 1 that extends in the left-right direction. The bed portion 11 has a base 15, a foot 16, and a free arm 17. The base 15 is the portion of the bed portion 11 on the right side of the approximate left-right center of the bed portion 11. The foot 16 is a U-shaped part having a pair of round rod-shaped members that extend leftward from the bottom portion on the left end portion of the base 15 and that connect in the front-rear direction at the left end. Rubber feet 18 are provided on the bottom surfaces of the base 15 and foot 16 to support the embroidery sewing machine 1 when the embroidery sewing machine 1 is placed on a desktop. The free arm 17 has a general square prism shape that extends leftward from the upper portion on the left end portion of the base 15. The front-rear and vertical dimensions of the free arm 17 are shorter than those of the base 15. The free arm 17 is positioned above the foot 16 so that a vertical gap is formed between the foot 16 and the free arm 17.

The column portion 12 extends upward from the right end portion of the bed portion 11. The arm portion 13 extends leftward from the upper end portion of the column portion 12 and parallel to the bed portion 11. The arm portion 13 includes a support portion 80. The head portion 14 is coupled with the left end portion of the arm portion 13.

The embroidery sewing machine 1 also has a rotary hook mechanism and the like (not shown) disposed inside the free arm 17 of the bed portion 11. The rotary hook mechanism loops a needle thread (not shown) around a bobbin thread (not shown) beneath a throat plate (not shown), which is provided on a top surface 17A of the free arm 17. A sewing machine motor (not shown) is provided inside the base 15. A spool holder 19 is provided on the top of the column portion 12. The spool holder 19 is configured to hold a thread spool (not shown) around which the needle thread is wound. A main shaft (not shown) extending in the left-right direction is provided inside the arm portion 13. The main shaft is driven to rotate by the sewing machine motor. A needle bar 6 and a presser bar 8 are provided at the head portion 14. A needle 6A is detachably mounted on the lower end of the needle bar 6. A presser foot 9 is detachably mounted on the bottom end of the presser bar 8. The needle bar 6 is driven to move vertically by the rotation of the main shaft.

The embroidery frame 40 is a frame body for holding a workpiece such as a fabric to be processed. In the present embodiment, the embroidery frame 40 has a general square shape in a plan view, but rectangular, circular, and oblong embroidery frames may be selectively used as appropriate for the embroidery content. A connecting part 41 is provided on the right side of the embroidery frame 40 for connecting the embroidery frame 40 to the carriage 50.

Figure 2:
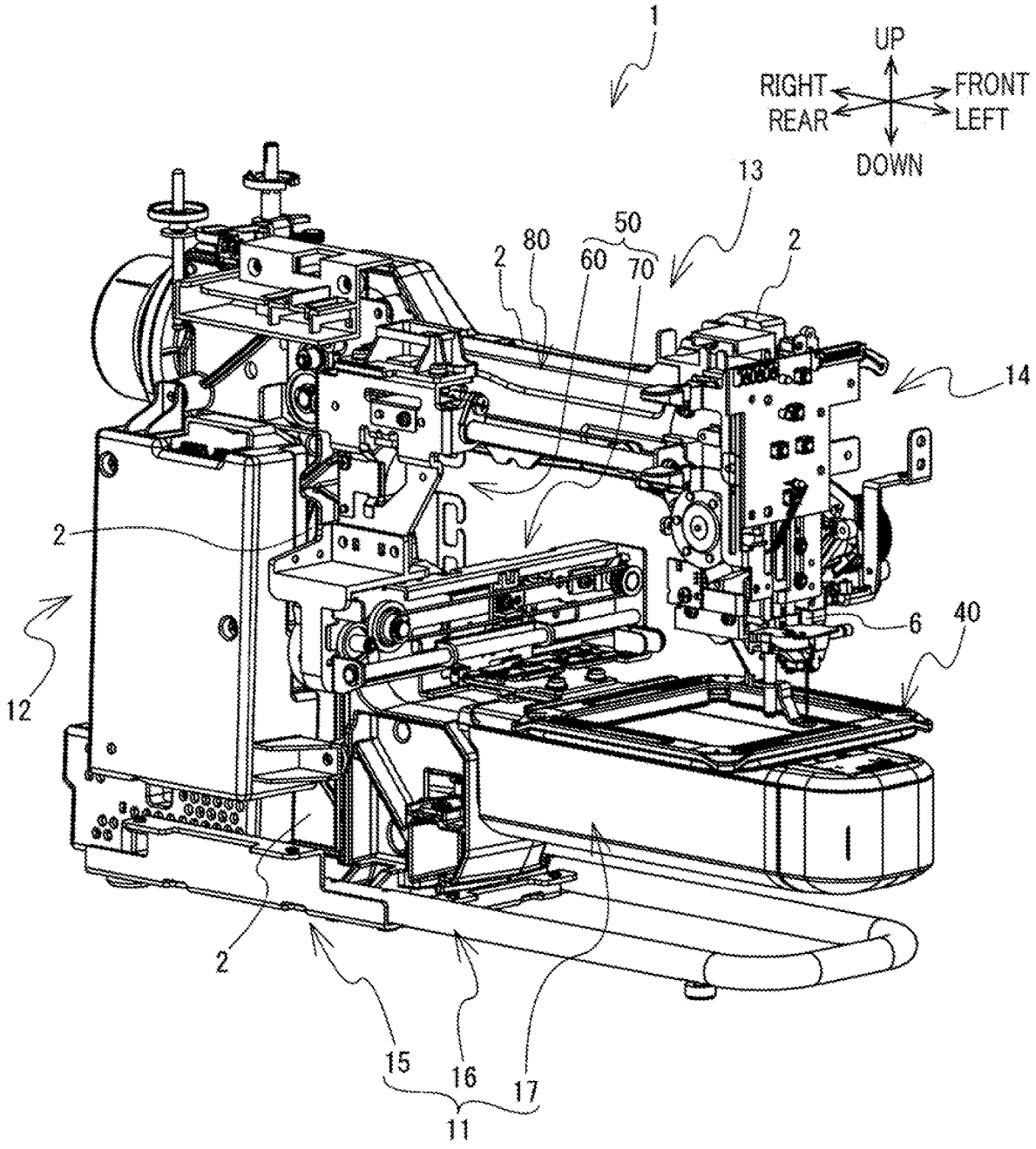
FIG. 2 is a perspective view of the internal structure of the embroidery sewing machine 1 from the rear-upper-left side thereof.

Next, the carriage 50 will be described with reference to FIGS. 2 through 8. As shown in FIG. 2, the carriage 50 is configured to move a workpiece held by the embroidery frame 40 in the front-rear direction and left-right direction relative to the needle bar 6. The carriage 50 is supported by the support portion 80 and hangs down from the arm portion 13. The support portion is provided at the rear side portion of the arm portion 13. More specifically, the support portion is provided on the rear side of the sewing machine frame 2 in the arm portion 13. Together with the arm portion 13, the support portion 80 is also covered by the cover.

A slit (not shown) extending in the left-right direction is formed in a rear portion on the bottom surface of the cover covering the arm portion 13. The lower portion of a hanging arm plate 61 (described later) of the carriage 50 is exposed on the outside of the cover through the slit. The hanging arm plate 61 is supported by the support portion 80 and configured to be moved in the left-right direction. However, the area of the slit opening formed in the bottom surface of the cover can be reduced since the thickness dimension of the hanging arm plate 61 is aligned in the front-rear direction, as will be described later.

Figure 3:
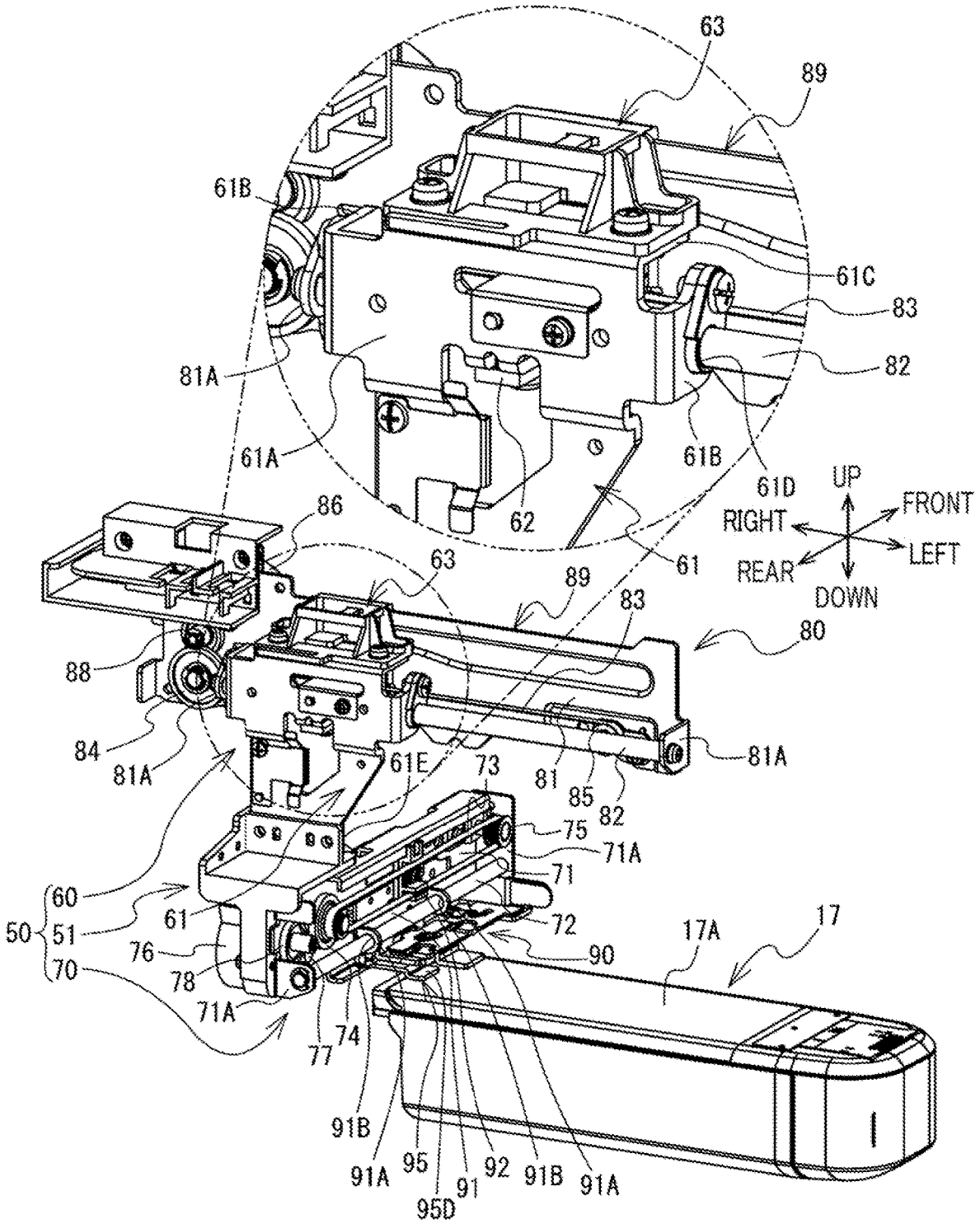
FIG. 3 is a perspective view of a carriage 50 and a free arm 17 from the rear-upper-left side thereof.
Figure 4:
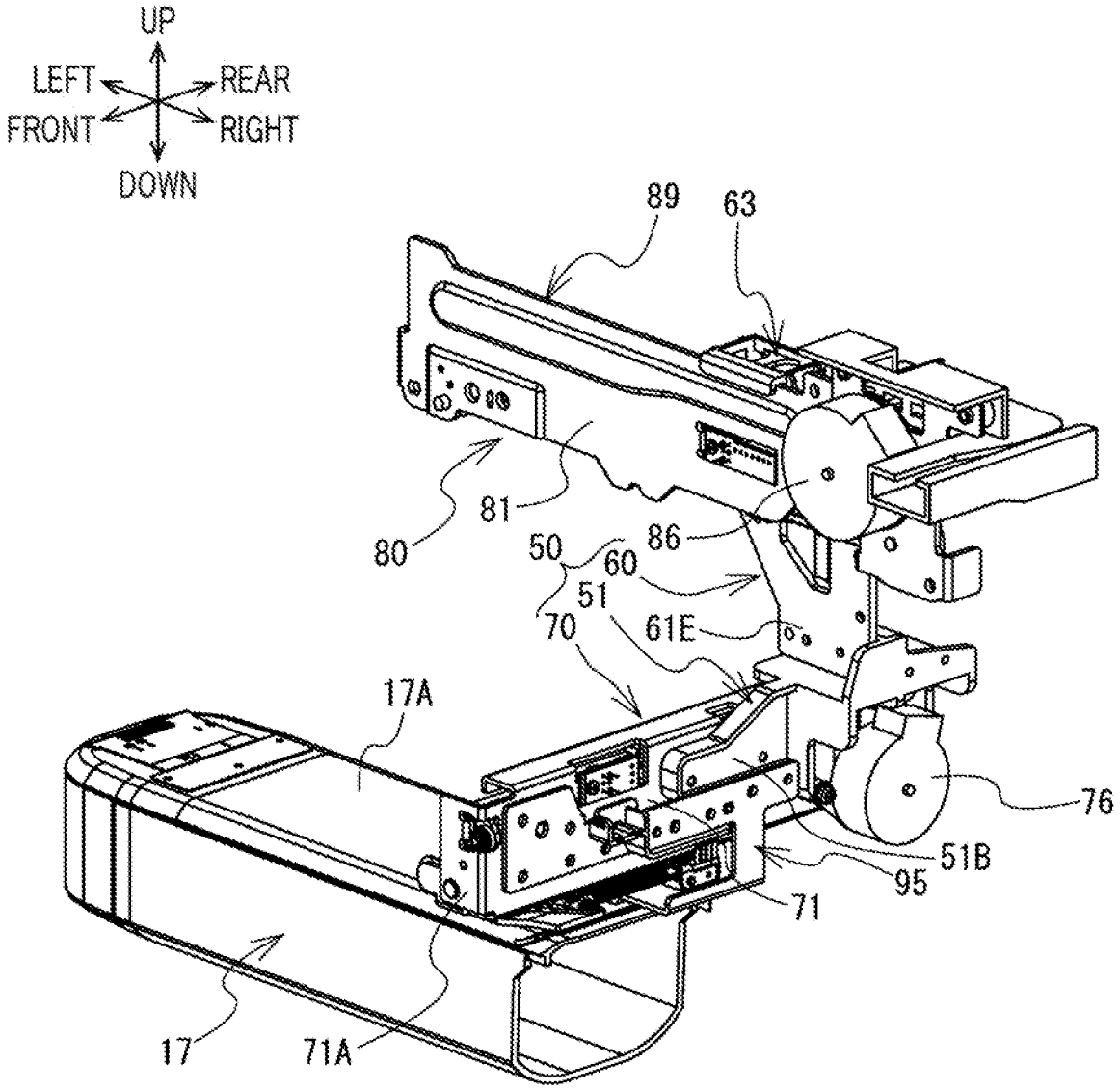
FIG. 4 is a perspective view of the carriage 50 and free arm 17 from the front-upper-right side thereof.

As shown in FIGS. 3 and 4, the support portion 80 includes a back plate 81, a support shaft 82, a belt 83, a drive pulley 84, a pulley 85, a left-right drive motor 86, a drive gear (not shown), and a driven gear 88. The back plate 81 has a plate-like shape that extends in the left-right direction and whose width direction is aligned in the vertical direction. The back plate 81 is fixed by screws to the rear surface of the sewing machine frame 2 in the arm portion 13. The top edge of the back plate 81 extends straight in the left-right direction and constitutes a restriction part 89 described later. The back plate 81 has a pair of side protrusions 81A. One side protrusion 81A is provided on the bottom portion of each of the left and right ends of the back plate 81 and is folded rearward. The support shaft 82 has a shaft-like shape. The support shaft 82 is disposed between the two side protrusions 81A. Both end portions of the support shaft 82 are fixed to the corresponding side protrusions 81A by screws. The left-right length of the support shaft 82 is approximately the same as the length of the arm portion 13.

The belt 83 is stretched between the drive pulley 84 and the pulley 85 and is disposed between the support shaft 82 and the back plate 81. The drive pulley 84 is disposed in the lower-right corner on the rear surface of the back plate 81. The pulley 85 is disposed in the lower-left corner on the rear surface of the back plate 81. The left-right drive motor 86 is fixed to the upper-right corner on the front surface of the back plate 81. A drive shaft of the left-right drive motor 86 protrudes rearward from the rear surface of the back plate 81 and is fitted into the drive gear. The drive gear is meshingly engaged with the driven gear 88. The driven gear 88 is disposed in the upper-right corner on the rear surface of the back plate 81 and is meshingly engaged with the drive pulley 84. Accordingly, the belt 83 circulates in accordance with the drive of the left-right drive motor 86.

The carriage 50 includes a carriage moving portion 60, a frame moving portion 70, and a connecting member 51. The carriage moving portion 60 includes the hanging arm plate 61, a gripping member 62, and a rotation suppressing member 63.

The hanging arm plate 61 has a plate-like shape that extends vertically and whose width direction is aligned in the left-right direction. Within the vertical mid-portion of the hanging arm plate 61, the dimension of the hanging arm plate 61 in the width direction narrows toward the bottom. The hanging arm plate 61 has an upper end portion 61A. In a rear view, the upper end portion 61A has a general rectangular shape that is elongated in the left-right direction. The hanging arm plate 61 also has a pair of side protruding parts 61B, and a top protruding part 61C formed by folding the respective left and right edges and the top edge of the upper end portion 61A toward the front. A circular hole 61D is formed in each of the side protruding parts 61B. The support shaft 82 of the support portion 80 is inserted through the circular holes 61D.

The gripping member 62 is fixed to the bottom of the upper end portion 61A. The gripping member 62 has a plate-like shape that extends frontward, and the distal end is bifurcated into upper and lower parts that grip the belt 83. Therefore, the carriage moving portion 60 is supported on the support shaft 82 and moves in left and right directions in accordance with the drive of the left-right drive motor 86. The hanging arm plate 61 also has a lower end portion 61E. The lower end portion 61E is fixed with screws to the connecting member 51 described later and is connected to the frame moving portion 70 via the connecting member 51.

Figure 5:
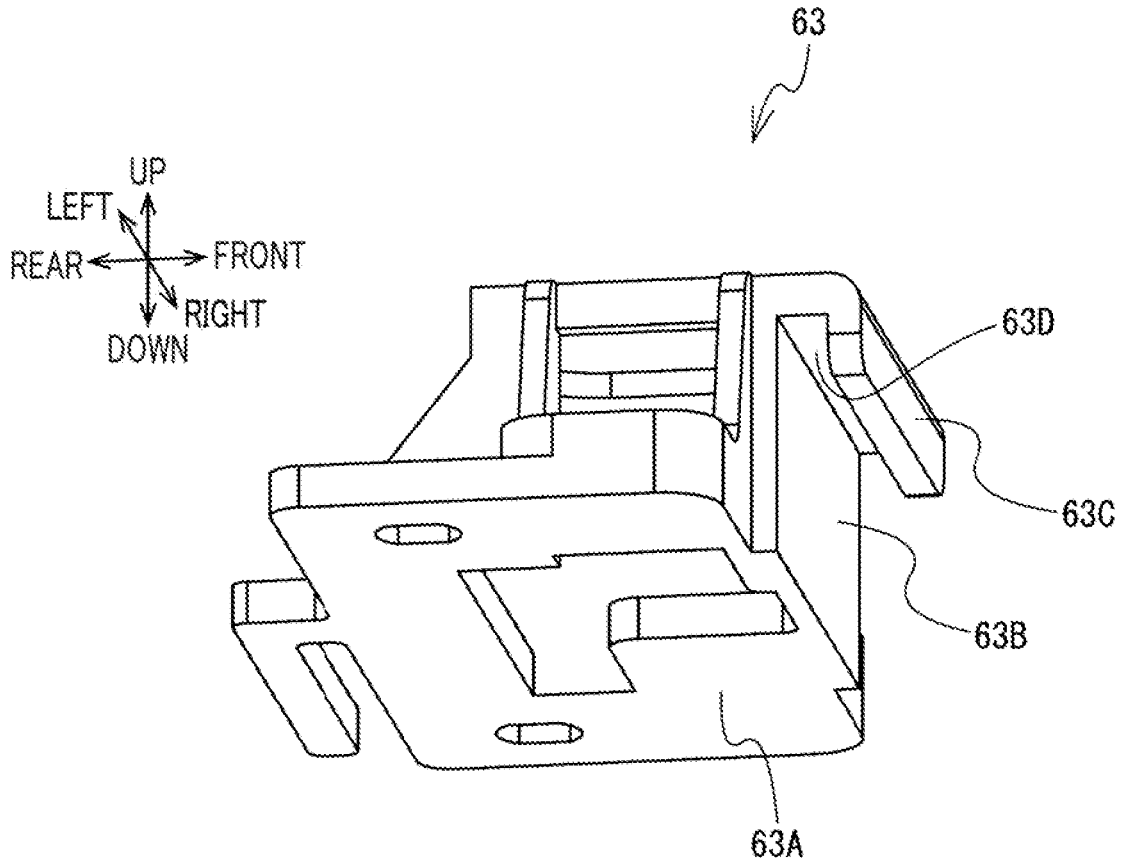
FIG. 5 is a perspective view of a rotation suppressing member 63 from the front-lower-left side thereof.

The rotation suppressing member 63 is fixed to the top protruding part 61C with screws. As shown in FIG. 5, the rotation suppressing member 63 has a base 63A, a rear contact part 63B, a front contact part 63C, and a connecting part 63D.

The base 63A is the portion of the rotation suppressing member 63 that is fixed to the hanging arm plate 61. The bottom surface of the base 63A is substantially the same size as the top surface of the top protruding part 61C. The rear contact part 63B has a plate-like shape that extends vertically from the front end portion of the base 63A and whose thickness direction is aligned in the front-rear direction. The front contact part 63C is positioned frontward of the rear contact part 63B. A gap equivalent to the thickness of the back plate 81 is formed between the front contact part 63C and the rear contact part 63B. The front contact part 63C has a plate-like shape that extends in the left-right direction and whose thickness direction is aligned in the front-rear direction. The top edges of the rear contact part 63B and front contact part 63C are at the same vertical position. The connecting part 63D connects the top edges of the rear contact part 63B and front contact part 63C in the front-rear direction. The connecting part 63D has a plate-like shape whose thickness direction is aligned in the vertical direction. Accordingly, at the front end portion of the base 63A, the rear contact part 63B, front contact part 63C, and connecting part 63D form a hook shape with the hooking part extending downward. The restriction part 89 of the back plate 81 is disposed between the rear contact part 63B and front contact part 63C.

Figure 6:
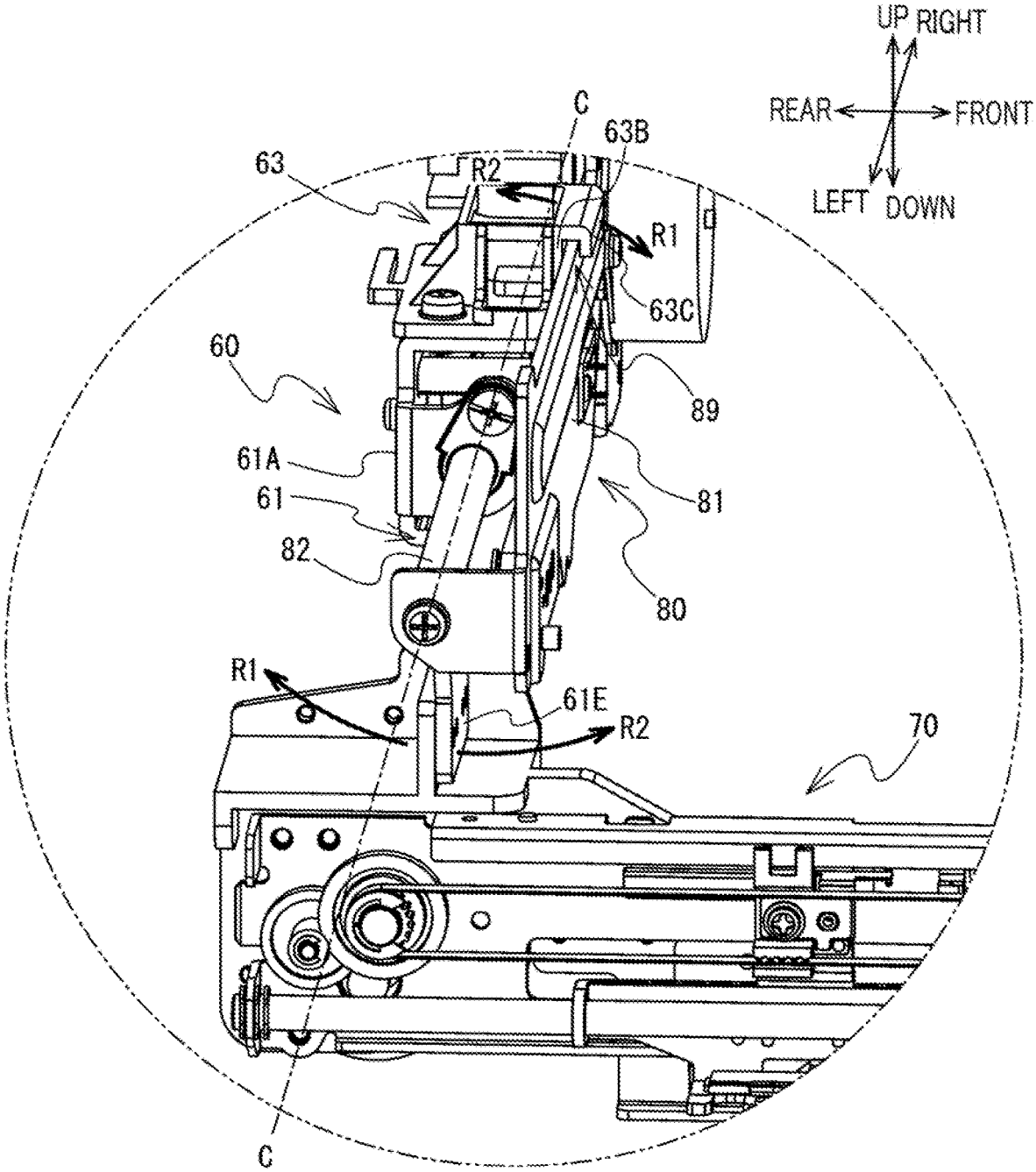
FIG. 6 is an enlarged perspective view of the periphery of the rotation suppressing member 63 from the front-upper-left side thereof.

Since the hanging arm plate 61 is configured to be suspended from and supported by the support shaft 82, the weight of the frame moving portion 70 could cause the carriage 50 to rotate (and more specifically, pivotally move) about the support shaft 82, as illustrated in FIG. 6. The support shaft has a shaft-like shape having a center axis C extending in the left-right direction. Therefore, the carriage 50 could rotate in a circumferential direction R1, which is the clockwise direction around the center axis C in a left side view, or in a circumferential direction R2, which is the counterclockwise direction around the center axis C in a left side view. If the carriage 50 begins to rotate in the circumferential direction R1, the front surface of the rear contact part 63B comes into contact with the restriction part 89 of the back plate 81 and hence the rotation suppressing member 63 does not move further in the circumferential direction R1, thereby suppressing rotation of the carriage 50. If the carriage 50 begins to rotate in the circumferential direction R2, the rear surface of the front contact part 63C comes into contact with the restriction part 89 of the back plate 81 and hence the rotation suppressing member 63 does not move further in the circumferential direction R2, thereby suppressing rotation of the carriage 50. Since the restriction part 89 extends along a straight line in the left-right direction, the restriction part 89 does not interfere with the front contact part 63C and rear contact part 63B, which are provided on the front and rear sides of the restriction part 89, during movement of the carriage moving portion 60 in the left-right direction.

As shown in FIGS. 3 and 4, the frame moving portion 70 has a back plate 71, a support shaft 72, a belt 73, a drive pulley 74, a pulley 75, a front-rear drive motor 76, a drive gear 77, a driven gear 78, a holder 90, a gripping member 92, and a contact member 95.

The back plate 71 has a plate-like shape that is elongated in the front-rear direction and whose width dimension is aligned in the vertical direction. The back plate 71 functions as the frame member of the frame moving portion 70. A cover (not shown) for covering the frame moving portion 70 is fixed to the back plate 71. The back plate 71 has a pair of side protruding parts 71A. One side protruding part 71A is provided on each of the front and rear ends of the back plate 71 and is folded toward the left.

The support shaft 72 has a shaft-like shape extending in the front-rear direction. The support shaft 72 is disposed between the two side protruding parts 71A. Each end portion of the support shaft 72 is fixed to the corresponding side protruding part 71A with a screw. The front-rear length of the support shaft 72 is substantially the same as the left-right length of the support shaft 82.

The belt 73 is arranged above the support shaft 72 and stretched around the drive pulley 74 and the pulley 75. The drive pulley 74 is disposed in the lower-rear corner on the left surface of the back plate 71. The pulley 75 is disposed in the lower-front corner on the left surface of the back plate 71. The front-rear drive motor 76 is fixed to the lower-rear corner on the right surface of the back plate 71 via the connecting member 51 described later. A drive shaft of the front-rear drive motor 76 protrudes leftward from the left surface of the back plate 71 and is fitted into the drive gear 77. The drive gear 77 is meshingly engaged with the driven gear 78, which is disposed in the lower-rear corner on the left surface of the back plate 71, and the driven gear 78 is meshingly engaged with the drive pulley 74. Accordingly, the belt 73 circulates in accordance with the drive of the front-rear drive motor 76.

The holder 90 is disposed on the lower portion of the right surface of the frame moving portion 70. The connecting part 41 of the embroidery frame 40 (see FIG. 1) is detachably attachable to the holder 90. The holder 90 is movable in the front-rear direction by the frame moving portion 70. In other words, the frame moving portion 70 is configured to move the holder in the front-rear direction. The carriage moving portion 60 is configured to move the frame moving portion 70 in the left-right direction, and accordingly, the holder 90 is also movable in the left-right direction.

The holder 90 includes a moving plate 91 that is positioned at the right end portion of the holder 90. The moving plate 91 has a plate-like shape that extends upward and whose thickness direction is aligned in the left-right direction. The moving plate 91 has a pair of side protruding parts 91A. The side protruding parts 91A are formed by folding the front and rear ends of the moving plate 91 toward the left. A circular hole 91B is formed in each of the side protruding parts 91A. The support shaft 72 is inserted through the circular holes 91B.

The gripping member 92 is fixed to the top portion of the moving plate 91. The gripping member 92 has a plate-like shape that extends leftward, and the leading edge of the gripping member 92 is bifurcated into upper and lower parts that grip the belt 73. Therefore, in a state where the holder 90 is supported by the support shaft 72, the holder 90 moves in the front and rear directions in accordance with the drive of the front-rear drive motor 76. The user attaches the embroidery frame 40 to the holder 90 by pushing the connecting part 41 into the holder 90 from the left and removes the embroidery frame 40 by pulling the connecting part 41 leftward.

Figure 7:
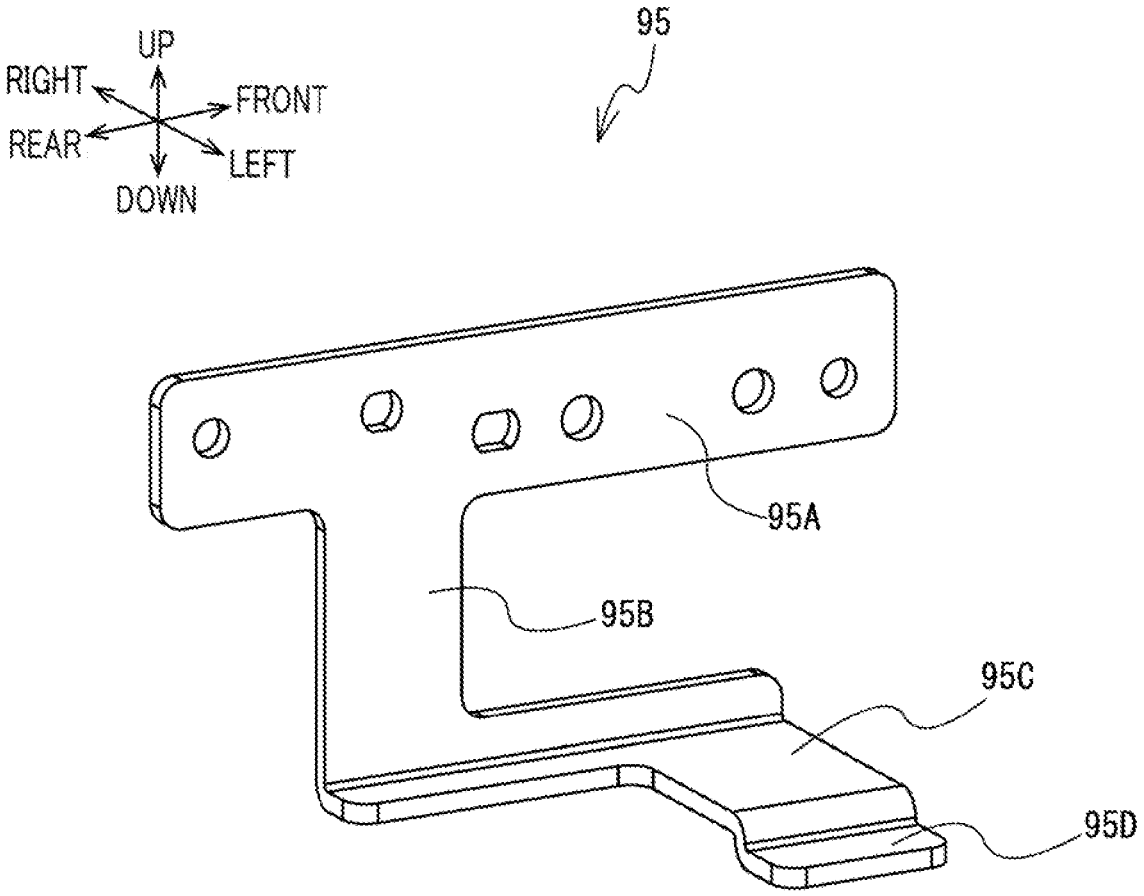
FIG. 7 is a perspective view of a contact member 95 from the rear-upper-left side thereof.

The contact member 95 is provided on the bottom portion of the frame moving portion 70. As shown in FIG. 7, the contact member 95 is formed by bending a plate material. The contact member 95 has a fixing part 95A, a vertical part 95B, a horizontal part 95C, and a contact part 95D.

The fixing part 95A has a plate-like shape that is elongated in the front-rear direction and whose width direction is aligned in the vertical direction. When the contact member 95 is mounted on the frame moving portion 70, the fixing part 95A is fixed by screws to the right surface of the back plate 71. The vertical part 95B is connected to the fixing part 95A at a position slightly rearward from the front-rear center of the fixing part 95A. The vertical part 95B extends downward from the fixing part 95A. The horizontal part 95C has a plate-like shape that extends leftward from the bottom edge of the vertical part 95B. The contact part 95D extends leftward from the left end of the horizontal part 95C and is formed in a step-like shape lower than the horizontal part 95C. A member having slidability such as a felt member is provided on the bottom surface of the contact part 95D.

As shown in FIGS. 3 and 4, the contact member 95 extends downward from the right side of the frame moving portion 70, and then bends and extends leftward so that the contact part 95D contacts the top surface 17A of the free arm 17. The position at which the contact part 95D contacts the top surface 17A moves in the left-right direction as the carriage 50 moves in the left-right direction. The position at which the contact part 95D contacts the top surface 17A does not change when the holder 90 moves in the front-rear direction. Further, by making the horizontal part 95C extend horizontally (frontward), the horizontal part 95C is more flexible and can more easily maintain the contact part 95D in contact with the top surface 17A. The contact part 95D of the contact member 95 is always maintained in contact with the top surface 17A in order to mitigate vibrations and the like that may occur during movement of the carriage 50 and to stabilize movement of the embroidery frame 40.

Figure 8:
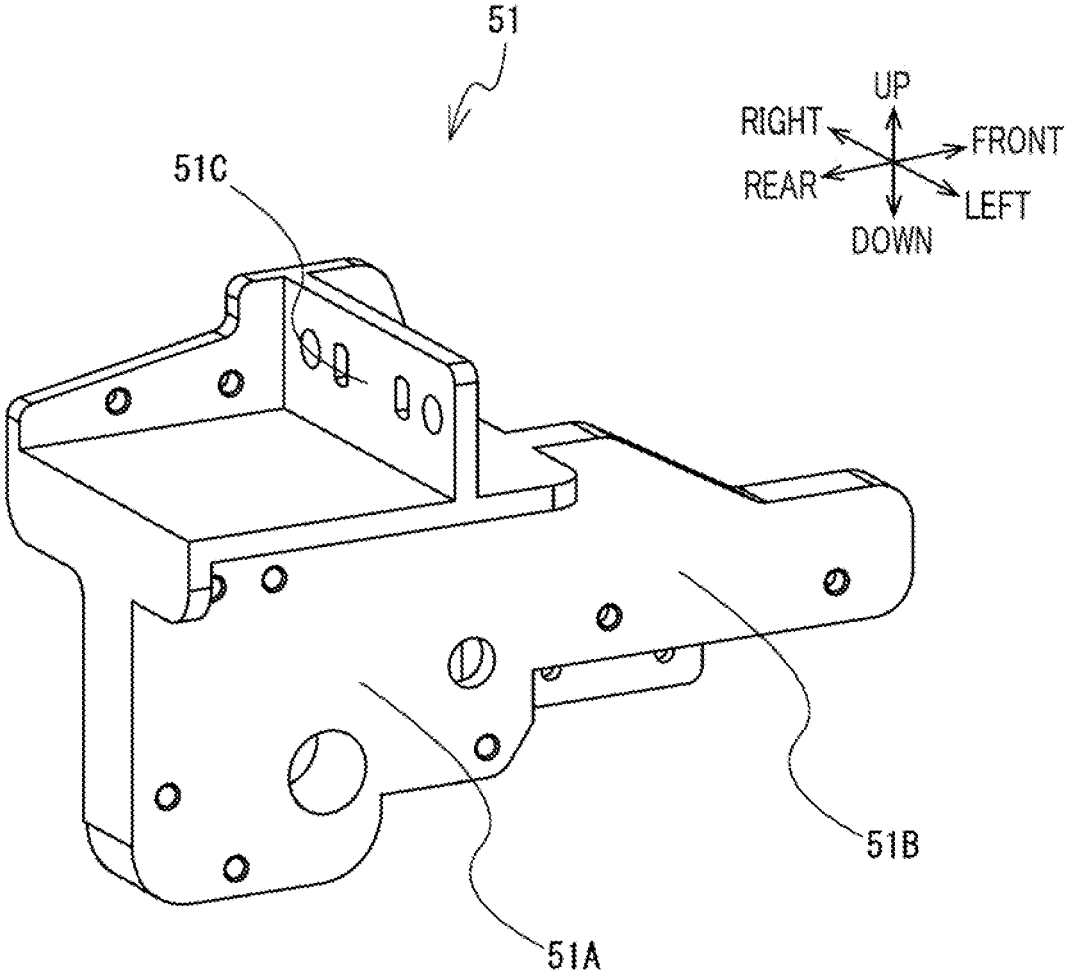
FIG. 8 is a perspective view of a connecting member 51 from the rear-upper-left side thereof.

The connecting member 51 connects the carriage moving portion 60 to the frame moving portion 70. As shown in FIG. 8, the connecting member 51 has a fixing part 51A, an extended part 51B, and a mounting part 51C. The fixing part 51A has a plate-like shape that is substantially rectangular and whose thickness direction is aligned in the left-right direction. A plurality of ribs is provided on the right surface of the fixing part 51A to ensure strength. The extended part 51B is a plate-like shape that extends frontward from the front end portion of the fixing part 51A. The fixing part 51A and the extended part 51B share the same left surface. The connecting member 51 is fixed to the frame moving portion 70 by screws with the left surfaces of the fixing part 51A and extended part 51B in contact with the right surface of the back plate 71 in the frame moving portion 70. The mounting part 51C has a plate-like shape whose thickness direction is aligned in the front-rear direction. The mounting part 51C is provided on the top of the fixing part 51A. The mounting part 51C is fixed to the hanging arm plate 61 by screws with the front surface of the mounting part 51C in contact with the rear surface on the lower end portion 61E of the hanging arm plate 61. In this way, the carriage moving portion 60 and frame moving portion 70 are connected via the connecting member 51.

The holder 90 to which the connecting part 41 of the embroidery frame 40 is attachable is positioned on the left side of the frame moving portion 70, as illustrated in FIGS. 3 and 4. On the other hand, the connecting member 51 that is fixed to the right surface on the back plate 71 of the frame moving portion 70 is positioned on the right side of the frame moving portion 70. In a process in which the embroidery frame 40 is attached to the holder 90, the holder 90 receives an external force from the left due to the pressure applied when attaching the embroidery frame 40. Since the connecting member 51 is fixed to the right side of the frame moving portion 70, which is the side opposite the left side on which the holder 90 is provided, the external force from attachment of the embroidery frame 40 is applied to the connecting member 51. Since the connecting member 51 includes the extended part 51B, the connecting member 51 also reinforces the frame moving portion 70 over a wider range on the right surface of the frame moving portion 70.

In the above-described embodiment, the embroidery sewing machine 1 includes the bed portion 11, the column portion 12, the arm portion 13, and the carriage 50. The bed portion 11 extends in the left-right direction. The column portion extends upward from the right end portion of the bed portion 11. The arm portion 13 extends in the left-right direction from the upper end portion of the column portion 12. The arm portion 13 has the rear side portion and the front side portion in the front-rear direction crossing the left-right direction. The arm portion 13 includes the support portion 80 provided at the rear side portion of the arm portion 13. The embroidery frame 40 for holding a workpiece is attachable to the carriage 50. The carriage 50 includes the frame moving portion 70 and the carriage moving portion 60. The frame moving portion 70 is configured to move the embroidery frame 40 in the front-rear direction in a state where the embroidery frame 40 is attached to the carriage. The carriage moving portion 60 is configured to move the frame moving portion 70 in the left-right direction. The carriage moving portion 60 is supported by the support portion 80. The carriage moving portion 60 extends downward. The lower end portion of the carriage moving portion 60 is connected to the frame moving portion 70.

The support portion 80 includes the support shaft 82 extending in the left-right direction. The support shaft 82 has the center axis C extending in the left-right direction. The support shaft 82 supports the carriage moving portion 60 so as to enable the carriage 50 to move in the left-right direction. The carriage moving portion 60 includes the rotation suppressing member 63 configured to suppress the carriage 50 from rotating about the support shaft 82 in the circumferential directions R1 and R2 of the center axis C.

The support shaft 82 has a shaft-like shape. The support portion 80 includes the restriction part 89 extending in parallel to the support shaft 82. The rotation suppressing member 63 includes the rear contact part 63B and front contact part 63C which are configured to contact the restriction part 89 in the circumferential directions R1 and R2.

The restriction part 89 has a plate-like shape. The rear contact part 63B and front contact part 63C extend in the vertical direction. The rear contact part 63B is arranged on the rear side of the restriction part 89 in the front-rear direction and the front contact part 63C is arranged on the front side of the restriction part 89 in the front-rear direction. The upper end portion of the rear contact part 63B and the upper end portion of the front contact part 63C are connected to each other so that the rotation suppressing member 63 has a hook-like shape.

The support portion 80 includes the restriction part 89 extending in parallel to the support shaft 82. The rotation suppressing member 63 is positioned upper than the support shaft 82. The rotation suppressing member 63 is movable in the left-right direction relative to the restriction part 89. The rotation suppressing member 63 is configured to engage with the restriction part 89.

The frame moving portion 70 includes the contact member 95 that is in contact with the upper surface of the bed portion 11. The contact member 95 has a plate-like shape and extends downward. The lower end (the contact part 95D) of the contact member 95 is in contact with the top surface 17A of the bed portion 11 so as to be slidingly movable on the top surface 17A of the bed portion 11.

The carriage 50 includes the connecting member 51 connecting the frame moving portion 70 to the lower end portion of the carriage moving portion 60. The connecting member 51 includes the extended part 51B extending in the front-rear direction. The connecting member 51 is fixed to the frame moving portion 70 with the extended part 51B in contact with at least one side surface of side surfaces of the frame moving portion 70.

The frame moving portion 70 includes the holder 90 to which the embroidery frame 40 is attachable. The holder 90 is provided on another side surface of the side surfaces of the frame moving portion 70, which surface is the opposite side surface of the one side surface with which the extended part 51B is in contact.

As described above, in the embroidery sewing machine 1, the carriage 50 is supported by the support portion 80 in a suspended state from the support portion 80, which is provided on the rear side portion of the arm portion 13. Therefore, the configuration around the arm portion 13 can be made simpler than a configuration in which the carriage 50 is suspended from both sides of the arm portion 13, enabling the embroidery sewing machine 1 to be made more compact and lightweight. Additionally, the number of parts required in the embroidery sewing machine 1 can be reduced to lower production costs.

Since the frame moving portion 70 is connected to the carriage moving portion 60, which is supported by the support shaft 82 in a suspended state, the carriage moving portion 60 can potentially rotate in the circumferential directions R1 and R2 about the support shaft 82, whose center axis C extends in the left-right direction. However, the rotation suppressing member 63 can suppress rotation of the carriage 50 in the circumferential directions R1 and R2 about the support shaft 82. Therefore, the embroidery sewing machine 1 can stabilize movement of the embroidery frame 40 using the carriage 50.

Since the support shaft 82 has a shaft-like shape, the configuration of the engagement portion for moving the carriage moving portion 60 can be made simple. Further, the rotation suppressing member 63 can suppress rotation of the carriage 50 in the circumferential directions R1 and R2 about the support shaft 82.

Since the rear contact part 63B and front contact part 63C of the rotation suppressing member 63 contact the restriction part 89 in the circumferential directions R1 and R2 about the support shaft 82, the rotation suppressing member 63 can more reliably suppress rotation of the carriage 50.

Since the restriction part 89 has a plate-like shape and the rotation suppressing member 63 has a hook-like shape configured to engage with the plate-shaped restriction part 89, rotation of the carriage 50 can be reliably suppressed through a simple construction that is easy to prepare.

The carriage moving portion 60 is supported by the support shaft 82, extends downward, and connects to the frame moving portion 70. Since the rotation suppressing member 63 is configured to engage with the restriction part 89 at a position above the support shaft 82, the rotation suppressing member 63 can suppress rotation of the carriage 50 without interfering with the drive of the lower-positioned frame moving portion 70 or impeding movement of the carriage moving portion 60.

Since the upper portion of the carriage 50 is supported by and suspended from the support shaft 82 and the contact member 95 on the lower portion of the carriage 50 is in contact with the top surface 17A of the free arm 17, the position of the frame moving portion 70 is stable. Therefore, the carriage 50 can suppress vibrations generated during driving and can stabilize the posture of the embroidery frame 40.

Even with a simple plate-shaped structure, the contact member 95 can sufficiently suppress vibrations generated when the carriage 50 is driven, thereby stabilizing the posture of the embroidery frame 40. Accordingly, this configuration can reduce the number of required parts and contribute to cost reduction.

The frame moving portion 70 extends in the front-rear direction for moving the embroidery frame 40 in the front-rear direction. The extended part 51B of the connecting member 51 extends in the front-rear direction, and the connecting member 51 is fixed to the frame moving portion 70 with the extended part 51B in contact with a side surface of the frame moving portion 70. The connecting member 51 is connected to the lower end portion 61E of the carriage moving portion 60, and the extended part 51B supports the frame moving portion 70, which extends in the front-rear direction. Therefore, the connecting member 51 of the carriage 50 firmly connects the carriage moving portion 60 to the frame moving portion 70, suppressing vibrations generated when the carriage 50 is driven to stabilize the posture of the embroidery frame 40.

External forces act on the frame moving portion 70 through the holder 90 when the embroidery frame 40 is attached and detached. The frame moving portion 70 is supported by the extended part 51B disposed on the right side of the frame moving portion 70, which is the side opposite the left side on which the holder 90 is disposed. Since the connection between the carriage moving portion 60 and frame moving portion 70 is strengthened, the user can stably attach the embroidery frame 40 to and detach the embroidery frame 40 from the carriage 50.

The left-right direction is an example of the first direction. The front-rear direction is an example of the second direction. The support shaft 82 is an example of the support member. The rotation suppressing member 63 is an example of the rotation suppressing part. The rear contact part 63B is an example of the first contact part. The front contact part 63C is an example of the second contact part. The connecting member 51 is an example of the connecting portion. The contact part 95D is an example of the lower end of the contact member. The holder 90 is an example of the frame attachment part.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below, and the examples described below may also be combined in various ways, provided there are no inconsistencies.

While the carriage 50 in the embodiment described above is not configured to be removable from the embroidery sewing machine 1, the carriage 50 may be configured to be removable, allowing the embroidery sewing machine 1 to be used as a normal sewing machine. The carriage 50 is supported by the support portion 80 provided at the rear side portion of the arm portion 13 in the embodiment, but the support portion 80 may be provided at the front side portion of the arm portion 13 instead. Alternatively, the carriage 50 may be configured to be suspended from support portions 80 provided at both front and rear side portions of the arm portion 13. In this case, the mechanism for moving the carriage 50 in left and right directions may be provided on either one of the support portions 80. Here, the frame moving portion 70 may be mounted on the carriage moving portion 60 at only one of the front and rear side portions of the frame moving portion 70. For example, the support portion 80 may be provided at each of the front and rear side portions of the arm portion 13; the frame moving portion 70 may be connected to the rear hanging arm plate 61 supported by the rear support portion 80; and the front hanging arm plate 61 supported by the front support portion 80 may be bent and extended rearward just beneath the arm portion 13 and connected to the middle of the rear hanging arm plate 61 supported by the rear support portion 80. In this configuration, the front hanging arm plate 61 may be disposed inside the cover of the arm portion 13 and connected to the middle of the rear hanging arm plate 61 inside the cover. Alternatively, a slit extending in the left-right direction may also be formed in the front portion on the bottom surface of the cover for the arm portion 13. In this case, the portion of the front hanging arm plate 61 that extending downward from the slit may be connected to the rear hanging arm plate 61 outside the cover of the arm portion 13. With this configuration, the hanging arm plate 61 supported by the front support portion 80 functions as the rotation suppressing part that suppresses rotation of the carriage 50 about the rear support portion 80.

The support portion 80 may also be provided outside the cover of the arm portion 13. In this case, the support portion 80 need only to be provided outside the cover for the arm portion 13 on either the front or the rear side of the central axis of the arm portion 13, which extends in the left-right direction.

The support member of the present disclosure is not limited to the support shaft 82 having a shaft-like shape, but may be a support member having a rail-like shape such as a linear guide. The contact part of the rotation suppressing member 63 is not limited to a hook shape, but rather the rotation suppressing member 63 may be provided with two support shafts that have shaft-like shapes and extend parallel to the arm portion 13, for example. In this case, the first support shaft may be used for suspending the carriage 50 while the second support shaft may be passed through circular holes to suppress rotation of the carriage 50. In other words, the circular holes through which the second support shaft is inserted may function as the rotation suppressing part.

In addition to the plate-shaped member described in this specification, the contact member 95 may have a rotary body at the distal end thereof and may be configured to support the carriage 50 while the rotary body rolls over the top surface 17A of the free arm 17. Further, while the extended part 51B of the connecting member 51 is fixed in contact with the right surface of the frame moving portion 70, the extended part 51B may be fixed in contact with the top surface, the bottom surface, two surfaces including the bottom surface and right surface, or three surfaces including the top surface in addition to the bottom and right surfaces.

The contact member 95 of the embodiment described above is configured to be provided at the right side of the frame moving portion 70, but is not limited to this configuration. For example, the contact member 95 may be provided at the left side of the frame moving portion 70, at both the right side and left side of the frame moving portion 70, or at the bottom of the frame moving portion 70.

What is claimed is:

1. An embroidery sewing machine comprising:

a bed portion extending in a first direction;

a column portion extending upward from an end portion of the bed portion;

an arm portion extending in the first direction from an upper end portion of the column portion, the arm portion having one side portion and the other side portion in a second direction crossing the first direction, the arm portion including a support portion provided at only the one side portion of the arm portion; and a carriage to which an embroidery frame for holding a workpiece is attachable, the carriage comprising:

a frame moving portion configured to move the embroidery frame in the second direction in a state where the embroidery frame is attached to the carriage; and a carriage moving portion configured to move the frame moving portion in the first direction, the carriage moving portion being supported by the support portion, the carriage moving portion extending downward and having a lower end portion connected to the frame moving portion.

2. The embroidery sewing machine according to claim 1, wherein the support portion comprises a support member extending in the first direction, the support member having a center axis extending in the first direction, the support member supporting the carriage moving portion so as to enable the carriage to move in the first direction, and wherein the carriage moving portion comprises a rotation suppressing part configured to suppress the carriage from rotating about the support member in a circumferential direction of the center axis.

3. The embroidery sewing machine according to claim 2, wherein the support member has a shaft-like shape.

4. The embroidery sewing machine according to claim 3, wherein the support portion further comprises a restriction part extending in parallel to the support member, and wherein the rotation suppressing part comprises a contact part configured to contact the restriction part in the circumferential direction.

5. The embroidery sewing machine according to claim 4, wherein the restriction part has a plate-like shape, wherein the contact part includes a first contact part and a second contact part which extend in a vertical direction, wherein the first contact part is arranged on one side of the restriction part in the second direction and the second contact part is arranged on the other side of the restriction part in the second direction, and wherein an upper end portion of the first contact part and an upper end portion of the second contact part are connected to each other so that the rotation suppressing part has a hook-like shape.

6. The embroidery sewing machine according to claim 2, wherein the support portion further comprises a restriction part extending in parallel to the support member, and wherein the rotation suppressing part is positioned upper than the support member, the rotation suppressing part being movable in the first direction relative to the restriction part, the rotation suppressing part being configured to engage with the restriction part.

7. The embroidery sewing machine according to claim 1, wherein the frame moving portion comprises a contact member in contact with an upper surface of the bed portion.

8. The embroidery sewing machine according to claim 7, wherein the contact member has a plate-like shape and extends downward, the contact member has a lower end in contact with the upper surface of the bed portion so as to be slidingly movable on the upper surface of the bed portion.

9. The embroidery sewing machine according to claim 1, wherein the carriage further comprises a connecting portion connecting the frame moving portion to the lower end portion of the carriage moving portion, wherein the connecting portion comprises an extended part extending in the second direction, and wherein the connecting portion is fixed to the frame moving portion with the extended part in contact with at least one side surface of side surfaces of the frame moving portion.

10. The embroidery sewing machine according to claim 9, wherein the frame moving portion comprises a frame attachment part to which the embroidery frame is attachable, and wherein the frame attachment part is provided on another side surface of the side surfaces of the frame moving portion, the another side surface being an opposite side surface of the one side surface with which the extended part is in contact.

11. An embroidery sewing machine comprising:

a bed portion extending in a first direction;

a column portion extending upward from an end portion of the bed portion;

an arm portion extending in the first direction from an upper end portion of the column portion, the arm portion having one side portion and another side portion in a second direction crossing the first direction, the arm portion including a support portion provided at the one side portion of the arm portion; and a carriage to which an embroidery frame for holding a workpiece is attachable, the carriage being supported by the support portion, wherein the arm portion does not include any support portion supporting the carriage and provided at the other side portion of the arm portion.

* * * * *